US010492648B1

(12) United States Patent
Pimentel

(10) Patent No.: US 10,492,648 B1
(45) Date of Patent: Dec. 3, 2019

(54) BAR SOAP LIQUEFIER AND DISPENSER

(71) Applicant: Pavel Pimentel, Belleville, NJ (US)

(72) Inventor: Pavel Pimentel, Belleville, NJ (US)

( * ) Notice: Subject to any disclaimer, the term of this patent is extended or adjusted under 35 U.S.C. 154(b) by 0 days.

(21) Appl. No.: 16/049,895

(22) Filed: Jul. 31, 2018

(51) Int. Cl.
*A47K 5/08* (2006.01)
*A47K 5/12* (2006.01)

(52) U.S. Cl.
CPC . *A47K 5/08* (2013.01); *A47K 5/12* (2013.01)

(58) Field of Classification Search
CPC ..... A47K 5/08; A47K 5/12
USPC ... 222/145.6, 230, 321.7, 321.9, 372, 383.1, 222/401, 408.5, 459, 628
See application file for complete search history.

(56) References Cited

U.S. PATENT DOCUMENTS 1,771,292 A * 7/1930 Gallipoli ..... A47K 5/16 362/96
2,029,701 A 2/1936 Burditt
2,677,600 A 5/1954 Young
4,497,580 A * 2/1985 Doyel ..... B01F 7/1695 222/239
5,286,106 A * 2/1994 Burgos ..... B01F 7/0025 366/190
5,330,804 A 7/1994 Allison
5,368,387 A 11/1994 Creighton
5,636,922 A 6/1997 Clark
D610,917 S 3/2010 Ho
8,136,699 B2 3/2012 Bianchini
2007/0040296 A1 2/2007 Moore
2015/0201636 A1 8/2015 McCelendon
2016/0130073 A1* 5/2016 Jun ..... B05B 15/25 222/459
2016/0256015 A1 9/2016 Ophardt

* cited by examiner

*Primary Examiner* — Vishal Pancholi

(57) ABSTRACT

A bar soap liquefier and dispenser for liquifying soap bar remnants includes a container body having a bottom, an open top, an inner cavity, and a continuous side wall surrounding the inner cavity and extending from the bottom to the open top. The open top has an outer threading. A lid has a top side, a bottom side, and an inner threading that is selectively engageable with the outer threading. The lid has a central pump aperture extending from the top side through the bottom side. A pump assembly is through the pump aperture and is configured to pump a soapy liquid from the inner cavity of the container body through a spout. A blade assembly is coupled to the bottom side of the lid and is configured to cut into and secure a bar of soap to the bottom of the container body within the inner cavity.

7 Claims, 5 Drawing Sheets

BAR SOAP LIQUEFIER AND DISPENSER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to pump dispensers and more particularly pertains to a new pump dispenser for liquifying soap bar remnants.

BRIEF SUMMARY OF THE INVENTION

An embodiment of the disclosure meets the needs presented above by generally comprising a container body having a bottom, an open top, an inner cavity, and a continuous side wall surrounding the inner cavity and extending from the bottom to the open top. The open top has an outer threading. A lid has a top side, a bottom side, and an inner threading. The inner threading is selectively engageable with the outer threading of the open top of the container body. The lid has a central pump aperture extending from the top side through the bottom side. A pump assembly is coupled to the lid such that it extends from above the lid through the pump aperture and into the inner cavity. The pump assembly is configured to pump a soapy liquid from the inner cavity of the container body through a spout. A blade assembly is coupled to the bottom side of the lid and is configured to cut into and secure a bar of soap to the bottom of the container body within the inner cavity.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
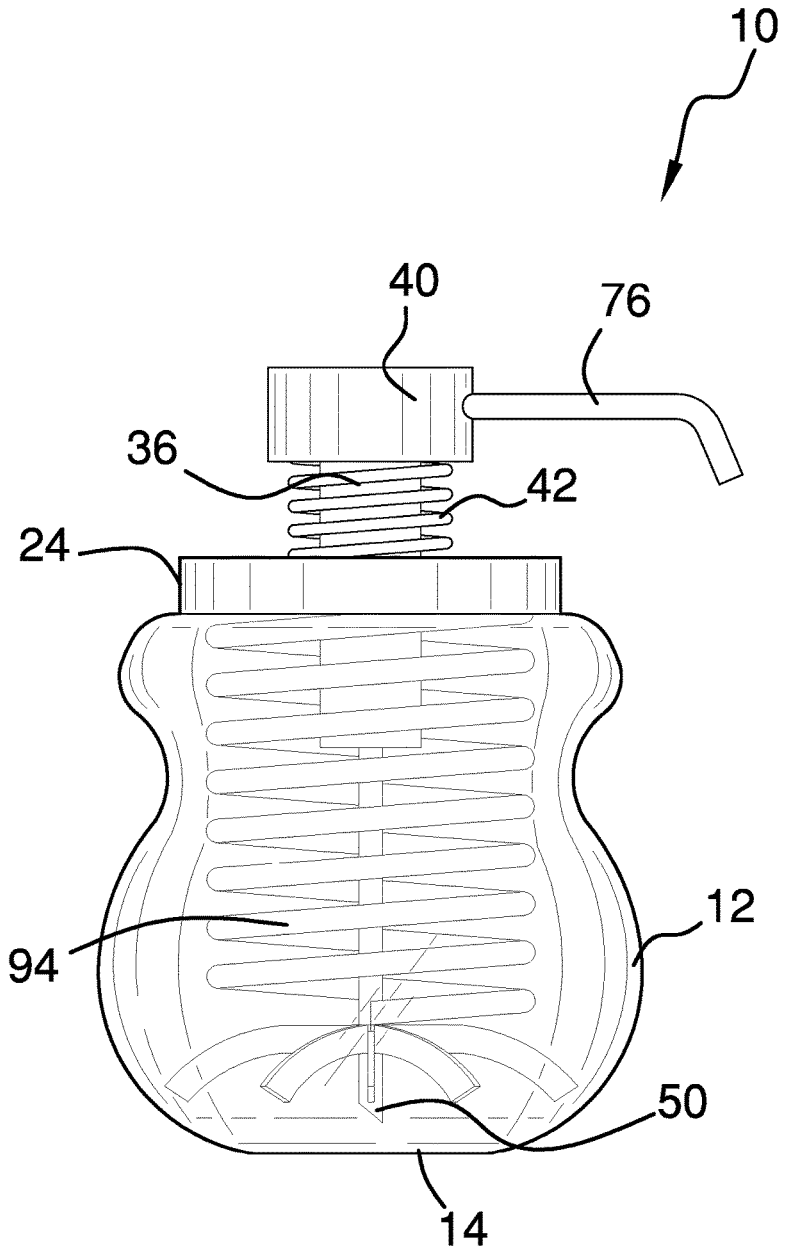
FIG. 1 is a side elevation view of a bar soap liquefier and dispenser according to an embodiment of the disclosure.
Figure 2:
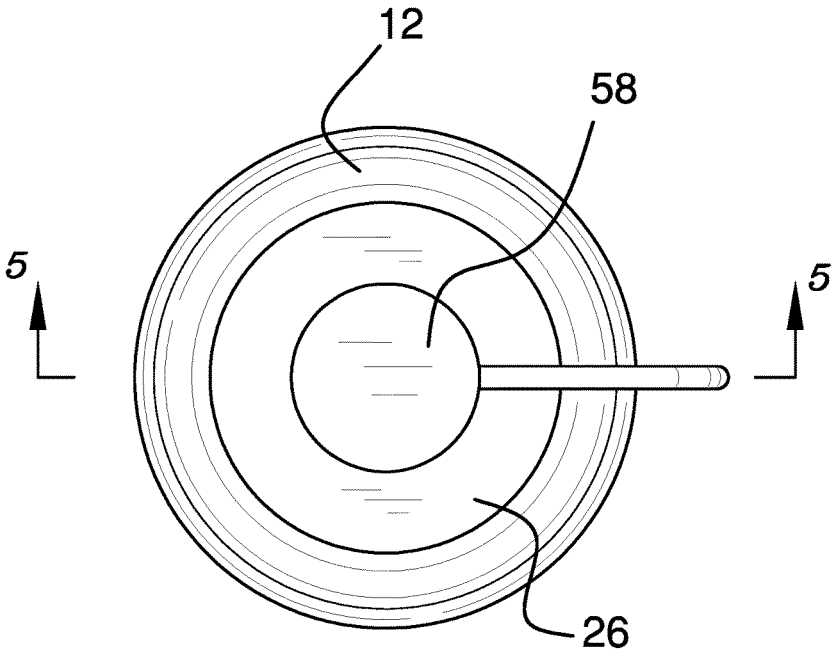
FIG. 2 is a top plan view of an embodiment of the disclosure.
Figure 3:
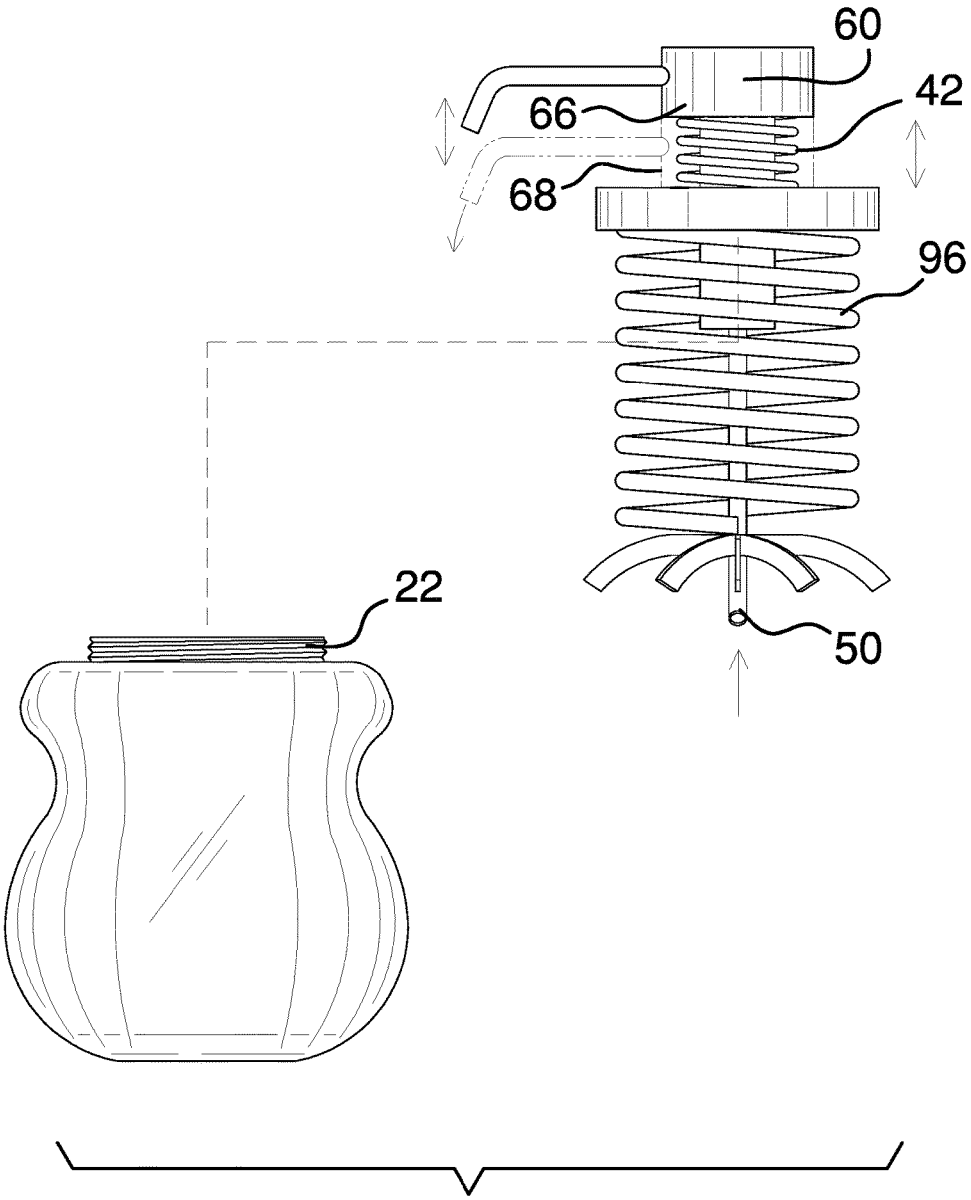
FIG. 3 is an exploded side elevation view of an embodiment of the disclosure.
Figure 4:
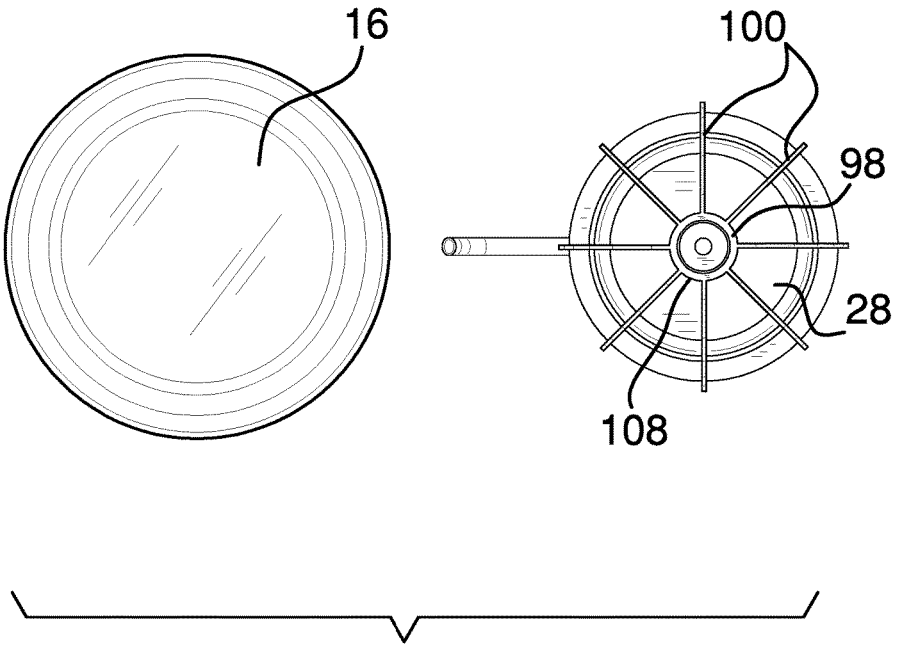
FIG. 4 is an exploded bottom plan view of an embodiment of the disclosure.
Figure 5:
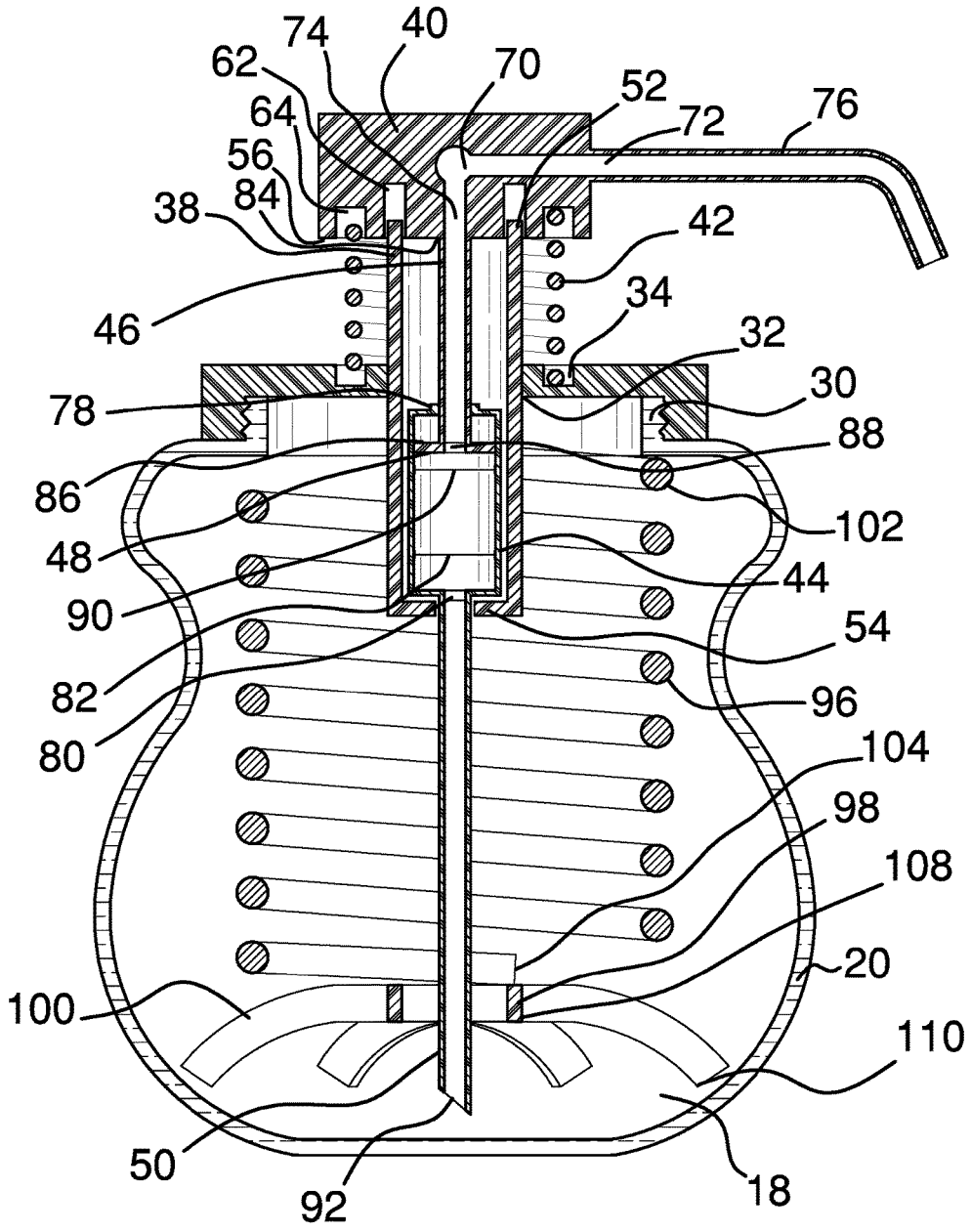
FIG. 5 is a cross-sectional view of an embodiment of the disclosure along line 5-5 of FIG. 2.

With reference now to the drawings, and in particular to FIGS. 1 through 5 thereof, a new pump dispenser embodying the principles and concepts of an embodiment of the disclosure and generally designated by the reference numeral 10 will be described.

As best illustrated in FIGS. 1 through 5, the bar soap liquefier and dispenser 10 generally comprises a container body 12 having a bottom 14, an open top 16, an inner cavity 18, and a continuous side wall 20 surrounding the inner cavity and extending from the bottom 14 to the open top 16. The open top has an outer threading 22. A lid 24 has a top side 26, a bottom side 28, and an inner threading 30 that is selectively engageable with the outer threading 22 of the open top of the container body to secure and alternatively separate the lid 24 and the container body 12. The lid 24 has a central pump aperture 32 extending from the top side 26 through the bottom side 28 and may have a first circular spring channel 34 in the top side concentric with the pump aperture.

A pump assembly 36 comprises a pump shaft 38, a pump knob 40, a pump spring 42, a pump body 44, a plunger shank 46, a plunger 48, and a pick-up tube 50. The hollow pump shaft 38 is coupled to the lid 24 through the central pump aperture 32. The pump shaft 38 has a top end 52 and a bottom end 54. The pump knob 40 has an underside 56, an upper side 58, and a perimeter 60 and is coupled to the top end 52 of the pump shaft. A circular shaft channel 62 extends from the underside 56 and receives the top end 52 of the pump shaft such that the pump shaft can slide within the shaft channel of the pump knob. The underside may also have a second circular spring channel 64 concentric with the shaft channel 62. The pump knob 40 has a rest position 66 with the pump shaft minimally engaged within the pump channel and an alternate depressed position 68 with the pump shaft fully engaged within the pump channel. The pump knob has an elbow channel 70 extending from a spout aperture 72 in the perimeter 60 to a plunger shank aperture 74 in the underside 56. A spout 76 is coupled to, and in fluid communication with, the spout aperture. The pump spring 42 is disposed coaxially with the pump shaft and extends between the first spring channel 34 of the lid and the second spring channel 64 of the pump knob. The pump spring returns the pump knob from the depressed position 68 to the rest position 66 once it is released. The pump body 44 is coupled within the bottom end 54 of the pump shaft. The pump body has a plunger aperture 78, a pick-up aperture 80, and a body diameter 82. The hollow plunger shank 46 has a knob end 84 coupled to, and in fluid communication with, the plunger shank aperture 74 of the pump knob. The plunger shank 46 coaxially extends through the pump shaft 38 and into the pump body through the plunger aperture 78. The plunger 48 is coupled to a pump end 86 of the plunger shank within the pump body. The plunger has a valve 88 centrally disposed therethrough to the plunger shank such that the valve is in fluid communication with the plunger shank 46. The valve may be a check valve. The plunger has a plunger diameter 90 substantially conforming to the body diameter 82 of the pump body such that the plunger 48 may travel within the pump body 44 when the pump knob 40 moves between the rest position and the depressed position to create suction within the pump body. The pick-up tube 50 is coupled to, and in fluid communication with, the pick-up aperture 80 of the pump body and extends to an uptake end 92 proximal the bottom 14 of the container body.

A blade assembly 94 comprises a blade spring 96, a blade hub 98, and a plurality of blades 100. The blade spring has a lid end 102 coupled to the bottom side of the lid and a blade end 104 coupled to the blade hub. The blade hub has a middle aperture 106 allowing the pick-up tube 50 to pass through the pump spring and the middle aperture. The plurality of blades is coupled to an outside 108 of the blade hub. Each of the plurality of blades 100 has a bottom edge 110 that sits proximal the bottom 14 of the container body when the lid 24 is engaged with the container body 12. Each of the plurality of blades may be concave relative the bottom of the container body to better secure a bar of soap or a plurality of soap slivers. The plurality of blades may be eight.

In use, a solid soap mass, such as the bar of soap or the plurality of soap slivers, is placed on the bottom 14 of the container body and covered in water. The lid 24 is then engaged with the open top 16 of the container body, with the blade spring 96 applying pressure to the blade hub 98 and forcing the plurality of blades 100 onto the solid soap mass. The plurality of blades 100 will cut into and secure the soap mass to the bottom of the container body, turning the water into a soapy liquid. When the pump knob 40 is pushed from the rest position 66 to the depressed position 68 and then allowed to return to the rest position, suction within the pump body 44 created by the plunger 48 draws the soapy liquid through the pick-up tube 50 to fill the pump body. When the pump knob is pushed down to the depressed position again the soapy liquid moves through the valve 88 of the plunger and up the plunger shank 46 to pass through the elbow channel 70 and out the spout 76, and again draws more of the soapy liquid into the pump body when the pump spring returns the knob from the depressed position to the rest position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bar soap liquefier and dispenser comprising:

a container body, the container body having a bottom, an open top, an inner cavity, and a continuous side wall surrounding the inner cavity and extending from the bottom to the open top, the open top having an outer threading;

a lid coupled to the container body, the lid having a top side, a bottom side, and an inner threading, the inner threading being selectively engageable with the outer threading of the open top of the container body, the lid having a central pump aperture extending from the top side through the bottom side;

a pump assembly coupled to the lid, wherein the pump assembly is configured to pump a soapy liquid from the inner cavity of the container body through a spout;

a blade assembly coupled to the lid, the blade assembly being coupled to the bottom side of the lid and extending into the inner cavity, wherein the blade assembly is configured to cut into and secure a solid soap mass to the bottom of the container body within the inner cavity; and wherein the pump assembly further comprises a hollow pump shaft coupled to the lid, the pump shaft being coupled through the central pump aperture of the lid, the pump shaft having a top end and a bottom end, a pump knob coupled to the pump shaft, the pump knob having an underside, an upper side, and a perimeter, the pump knob having a circular shaft channel extending from the underside, the shaft channel slidingly receiving the top end of the pump shaft, the pump knob having a rest position and an alternate depressed position, the pump knob having an elbow channel extending from a spout aperture in the perimeter to a plunger shank aperture in the underside, the spout being coupled to, and in fluid communication with, the spout aperture, a pump spring coupled between the pump knob and the lid, the pump spring being disposed around the pump shaft and extending between the top side of the lid and the underside of the pump knob, the pump spring returning the pump knob from the depressed position to the rest position, a pump body coupled within the pump shaft, the pump body being coupled to the bottom end of the pump shaft, the pump body having a plunger aperture, a pick-up aperture, and a body diameter, a hollow plunger shank coupled to the pump knob, the plunger shank having a knob end coupled to, and in fluid communication with, the plunger shank aperture, the plunger shank coaxially extending through the pump shaft and into the pump body through the plunger aperture, a plunger coupled to the plunger shank, the plunger being coupled to a pump end of the plunger shank within the pump body, the plunger having a valve centrally disposed therethrough to the plunger shank, the valve being in fluid communication with the plunger shank, the plunger having a plunger diameter substantially conforming to the body diameter of the pump body, the plunger traveling within the pump body when the knob moves between the rest position and the depressed position, the plunger thus creating suction within the pump body, a pick-up tube coupled to the pump body, the pick-up tube being coupled to, and in fluid communication with, the pick-up aperture, and wherein the pump assembly is configured to draw the soapy liquid from the pump body through the valve of the plunger and the plunger shank to pass through the elbow channel and out the spout when the knob is pushed from the rest position to the depressed position, and to draw the soapy liquid into the pump body when the pump spring returns the knob from the depressed position to the rest position.

2. A bar soap liquefier and dispenser comprising:

a container body, the container body having a bottom, an open top, an inner cavity, and a continuous side wall surrounding the inner cavity and extending from the bottom to the open top, the open top having an outer threading;

a lid coupled to the container body, the lid having a top side, a bottom side, and an inner threading, the inner threading being selectively engageable with the outer threading of the open top of the container body, the lid having a central pump aperture extending from the top side through the bottom side;

a pump assembly coupled to the lid, wherein the pump assembly is configured to pump a soapy liquid from the inner cavity of the container body through a spout;

a blade assembly coupled to the lid, the blade assembly being coupled to the bottom side of the lid and extending into the inner cavity, wherein the blade assembly is configured to cut into and secure a solid soap mass to the bottom of the container body within the inner cavity; and wherein the blade assembly further comprises a blade spring coupled to the lid, the blade spring having a lid end coupled to the bottom side of the lid, a blade hub coupled to the blade spring, the blade hub being coupled to a blade end of the blade spring, the blade hub having a middle aperture, the pick-up tube passing through the middle aperture, and a plurality of blades coupled to the blade hub, the plurality of blades being coupled to an outside of the blade hub, each of the plurality of blades having a bottom edge, said bottom edge resting proximal the bottom of the container body when the lid is engaged.

3. The bar soap liquefier and dispenser of claim 1, wherein the blade assembly further comprises:

a blade spring coupled to the lid, the blade spring having a lid end coupled to the bottom side of the lid;

a blade hub coupled to the blade spring, the blade hub being coupled to a blade end of the blade spring, the blade hub having a middle aperture, the pick-up tube passing through the middle aperture; and a plurality of blades coupled to the blade hub, the plurality of blades being coupled to an outside of the blade hub, each of the plurality of blades having a bottom edge, said bottom edge resting proximal the bottom of the container body when the lid is engaged.

4. The bar soap liquefier and dispenser of claim 3, further comprising each of the plurality of blades being concave relative the bottom of the container body.

5. The bar soap liquefier and dispenser of claim 4, further comprising the plurality of blades being eight.

6. The bar soap liquefier and dispenser of claim 3, further comprising the lid having a first circular spring channel in the top side concentric with the central pump aperture and the pump knob having a second circular spring channel in the underside concentric with the shaft channel, the pump spring being coupled within each of the first spring channel and the second spring channel.

7. A bar soap liquefier and dispenser comprising:

a container body, the container body having a bottom, an open top, an inner cavity, and a continuous side wall surrounding the inner cavity and extending from the bottom to the open top, the open top having an outer threading;

a lid coupled to the container body, the lid having a top side, a bottom side, and an inner threading, the inner threading being selectively engageable with the outer threading of the open top of the container body, the lid having a central pump aperture extending from the top side through the bottom side and a first circular spring channel in the top side concentric with the central pump aperture;

a hollow pump shaft coupled to the lid, the pump shaft being coupled through the central pump aperture of the lid, the pump shaft having a top end and a bottom end;

a pump knob coupled to the pump shaft, the pump knob having an underside, an upper side, and a perimeter, the pump knob having a circular shaft channel extending from the underside, the shaft channel slidingly receiving the top end of the pump shaft, the underside having a second circular spring channel concentric with the shaft channel, the pump knob having a rest position and an alternate depressed position, the pump knob having an elbow channel extending from a spout aperture in the perimeter to a plunger shank aperture in the underside, the spout being coupled to, and in fluid communication with, the spout aperture;

a pump spring coupled between the pump knob and the lid, the pump spring being disposed around the pump shaft and extending between the first spring channel of the lid and the second spring channel of the pump knob, the pump spring returning the pump knob from the depressed position to the rest position;

a pump body coupled within the pump shaft, the pump body being coupled to the bottom end of the pump shaft, the pump body having a plunger aperture, a pick-up aperture, and a body diameter;

a hollow plunger shank coupled to the pump knob, the plunger shank having a knob end coupled to, and in fluid communication with, the plunger shank aperture, the plunger shank coaxially extending through the pump shaft and into the pump body through the plunger aperture;

a plunger coupled to the plunger shank, the plunger being coupled to a pump end of the plunger shank within the pump body, the plunger having a valve centrally disposed therethrough to the plunger shank, the valve being in fluid communication with the plunger shank, the plunger having a plunger diameter substantially conforming to the body diameter of the pump body, the plunger traveling within the pump body when the knob moves between the rest position and the depressed position, the plunger thus creating suction within the pump body;

a pick-up tube coupled to the pump body, the pick-up tube being coupled to, and in fluid communication with, the pick-up aperture;

wherein the pump shaft, the pump knob, the pump spring, the pump body, the plunger shank, the plunger, and the pick-up tube comprise a pump assembly configured to draw a soapy liquid from the pump body through the valve of the plunger and the plunger shank to pass through the elbow channel and out the spout when the knob is pushed from the rest position to the depressed position, and to draw the soapy liquid into the pump body when the pump spring returns the knob from the depressed position to the rest position;

a blade spring coupled to the lid, the blade spring having a lid end coupled to the bottom side of the lid;

a blade hub coupled to the blade spring, the blade hub being coupled to a blade end of the blade spring, the blade hub having a middle aperture, the pick-up tube passing through the middle aperture; and a plurality of blades coupled to the blade hub, the plurality of blades being coupled to an outside of the blade hub, each of the plurality of blades having a bottom edge, said bottom edge resting proximal the bottom of the container body when the lid is engaged, each of the plurality of blades being concave relative the bottom of the container body;

wherein the blade spring, the blade hub, and the plurality of blades comprise a blade assembly configured to cut into and secure a bar of soap to the bottom of the container body within the inner cavity.

* * * * *